US007861954B2

(12) United States Patent
Akisada et al.

(10) Patent No.: US 7,861,954 B2
(45) Date of Patent: Jan. 4, 2011

(54) ELECTROSTATIC ATOMIZER

(75) Inventors: Shousuke Akisada, Hikone (JP); Toshihisa Hirai, Hikone (JP); Kishiko Hiraki, legal representative, Hikone (JP); Sumio Wada, Hikone (JP); Tatsuhiko Matsumoto, Habikino (JP)

(73) Assignee: Panasonic Electric Works Co., Ltd., Kadoma-shi (JP)

( * ) Notice: Subject to any disclaimer, the term of this patent is extended or adjusted under 35 U.S.C. 154(b) by 374 days.

(21) Appl. No.: 11/988,687

(22) PCT Filed: Jul. 14, 2006

(86) PCT No.: PCT/JP2006/314098

§ 371 (c)(1),
(2), (4) Date: Jan. 11, 2008

(87) PCT Pub. No.: WO2007/010871

PCT Pub. Date: Jan. 25, 2007

(65) Prior Publication Data

US 2009/0206185 A1 Aug. 20, 2009

(30) Foreign Application Priority Data

Jul. 15, 2005 (JP) ..... 2005-207579

(51) Int. Cl.
*B05B 5/00* (2006.01)

(52) U.S. Cl. ..... 239/690; 239/706; 239/707

(58) Field of Classification Search ..... 239/690, 239/691.1, 706, 707, 67, 69; 361/228, 225, 361/226

See application file for complete search history.

(56) References Cited

U.S. PATENT DOCUMENTS

| | | | | |
|---|---|---|---|---|
| 5,337,963 | A | 8/1994 | Noakes | |
| 7,567,420 | B2 * | 7/2009 | Kobayashi et al. | 361/228 |

FOREIGN PATENT DOCUMENTS

| | | |
|---|---|---|
| JP | 62-173650 | 11/1987 |
| JP | 64-010712 | 1/1989 |
| JP | 3260150 | 12/1993 |
| JP | 06-046564 | 2/1994 |
| JP | 08-080037 | 3/1996 |
| JP | 2003-332023 | 11/2003 |
| JP | 2005-131549 | 5/2005 |
| JP | 2006-029663 | 2/2006 |
| JP | 2006-122819 | 5/2006 |

* cited by examiner

OTHER PUBLICATIONS

Notification of Reason(s) for Refusal mailed on Jan. 13, 2009, issued on the Japanese corresponding patent application No. JP2005-207579 and the English translation thereof.

*Primary Examiner*—Davis Hwu
(74) *Attorney, Agent, or Firm*—Edwards Angell Palmer & Dodge LLP

(57) ABSTRACT

An electrostatic atomizer including a discharge electrode, a counter electrode, a cooling source, a high voltage power supply and a voltage detector. The cooling source cools the discharge electrode to form thereon dew as water. The power supply applies high voltage for discharge across the electrodes. The detector detects voltage between the electrodes. The power supply includes a control device and a voltage stabilizing device that are opposite to each other in temperature characteristic. The control device operates to pick up the voltage detected with the detector via the voltage stabilizing device, and to adjust the high voltage applied across the electrodes through feedback control so that the voltage corresponds to specified discharge voltage.

5 Claims, 9 Drawing Sheets

ELECTROSTATIC ATOMIZER

BACKGROUND OF THE INVENTION

1. Field of the Invention

The invention relates generally to electrostatic atomizers and more particularly to an electrostatic atomizer that generates mist of charged fine particles in the order of nanometer in size.

2. Description of the Related Art

Such sort of electrostatic atomizer is seen in, for example, the patent document of Japanese Patent Number 3260150 (European Patent Publication Number 0 486 198 A1 or U.S. Pat. No. 5,337,963). A prior art device described in the document comprises a cartridge for storage of liquid suitable for electrostatic spraying, and a high voltage means for applying electrostatic potential to the liquid. The cartridge includes a capillary structure that extends into the interior of the cartridge so as to feed liquid by capillary action from the cartridge to a spraying outlet at a tip of the capillary structure. The cartridge also includes a means for providing an electrically conductive path to allow the application of an electrostatic charge to the liquid. When the high voltage means applies the potential to the liquid at the mouth of the spraying outlet, a potential gradient is developed between innermost and outermost peripheral surfaces of the mouth, and draws the liquid across an end face of the spraying outlet towards the outermost peripheral surface. Thereby, the liquid is projected electrostatically as an array of ligaments which form a halo around the mouth.

However, the prior art device requires that water is supplied into the cartridge. Also, an electrostatic atomizer that can solve this issue has been separately made by the applicant (see Japanese Patent Application Publication Number 2006-122819). This atomizer comprises a discharge electrode, a counter electrode located opposite the discharge electrode, a cooling source that cools the discharge electrode to form thereon dew as water, and a high voltage power supply that applies high voltage for discharge across the electrodes. Thus, by cooling the discharge electrode to form dew, the trouble of supplying water can be saved.

Incidentally, the atomizer repeats the Rayleigh splitting to realize electrostatic atomization. That is, when high voltage is applied across the electrodes, a negative electronic charge concentrates on the discharge electrode, and also water held on the tip of the discharge electrode rises like a cone to form a Taylor cone. When the negative electronic charge concentrates on the tip of the Taylor cone to become high density, repulsion of the electronic charge in the high density brings about Rayleigh splitting to split and scatter the Taylor cone shaped water. Thus, in the atomizer that repeats the Rayleigh splitting to realize electrostatic atomization, stable generation of high voltage is important.

SUMMARY OF THE INVENTION

It is therefore an object of the present invention to stably generate high voltage for forming mist of charged fine particles in the order of nanometer in size in addition to saving the trouble of supplying water.

An electrostatic atomizer of the present invention comprises a discharge electrode, a counter electrode located opposite the discharge electrode, a cooling source that cools the discharge electrode to form thereon dew as water, a high voltage power supply that applies high voltage for discharge across the electrodes, and a voltage detector that detects voltage between the electrodes. The power supply includes a control device and a voltage stabilizing device that are opposite to each other in temperature characteristic. The control device is configured to pick up the voltage detected with the detector via the voltage stabilizing device, and to adjust the high voltage applied across the electrodes through feedback control so that the voltage corresponds to specified discharge voltage. In this configuration, the discharge voltage between the electrodes is stabilized to the specified discharge voltage. Therefore, even under unstable temperature conditions, it is possible to stably generate high voltage for forming mist of charged fine particles in the order of nanometer in size.

Preferably, the atomizer further comprises a current detector that detects a current flowing between the electrodes, and a controller that adjusts a cooling rate of the cooling source based on a value of a predetermined specified current. The controller raises the rate when a value of the current detected with the current detector is smaller than the value of the specified current, and lowers the rate when the value of the current is larger than the value of the specified current. In this configuration, it is possible to suitably adjust quantity of the dew formed on the discharge electrode.

Preferably, the control device is a transistor, and the voltage stabilizing device has the opposite temperature characteristic in comparison with the temperature characteristic between the base and emitter of the control device.

It is preferable that the atomizer further comprises a resister for adjusting the high voltage of the power supply. In this case, the resister is connected in series with the voltage stabilizing device. In this configuration, the high voltage can be adjusted with a value of the resistor.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

Figure 1:
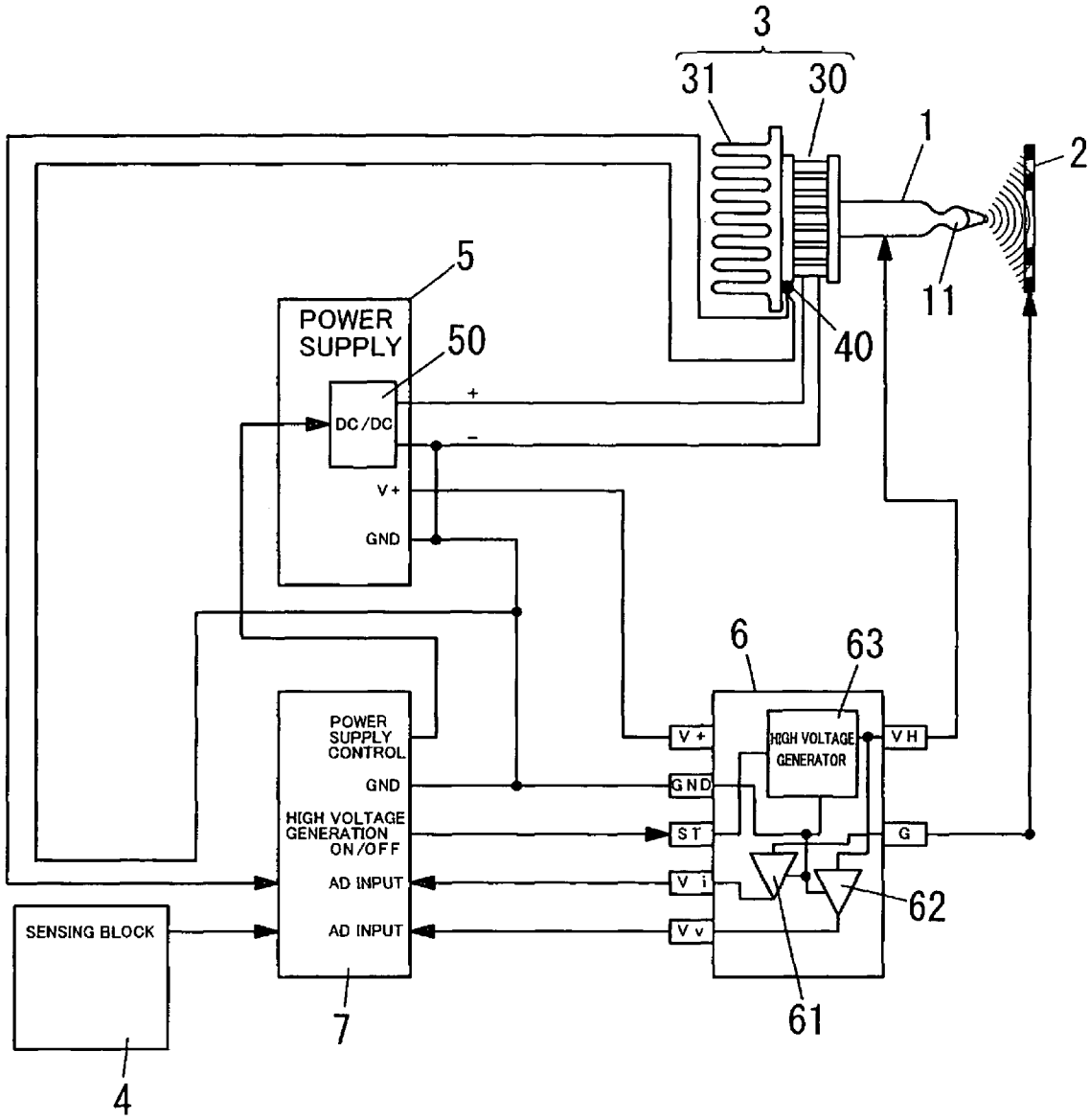
FIG. 1 is a schematic diagram of an embodiment according to the present invention.

FIG. 1 shows an embodiment according to the present invention (i.e., electrostatic atomizer). This electrostatic atomizer comprises a discharge electrode 1, a counter electrode 2, a cooling source 3, a sensing block 4, a DC power supply 5, a high voltage power supply 6 and a controller 7.

The discharge electrode 1 has a teardrop-shaped tip 11, and receives negative or positive high voltage (e.g., −4.6 kV) from the high voltage power supply 6 when it is discharged. The counter electrode 2 is formed into a ring shape of which inner edge functions as a substantial electrode, and is located opposite the tip 11 of the electrode 1 a given distance apart. The electrode 2 is also connected with ground.

The cooling source 3 is formed of, for example, a Peltier module 30 and a heat-radiating fin 31, and cools the discharge electrode 1 to a temperature lower than a dew point temperature of ambient air to form thereon dew as water. A base of the electrode 1 is connected with the cold side of the module 30, and the fin 31 is connected with the hot side of the module 30.

The sensing block 4 is formed of: a thermistor 40 that measures a temperature of the Peltier module 30 to provide the controller 7 with a measured temperature signal; a temperature sensor that measures an ambient temperature to provide the controller 7 with a measured temperature signal; a humidity sensor that measures ambient humidity to provide a measured humidity signal to the controller 7; and so on.

The DC power supply 5 is formed of, for example, a DC/DC converter 50 and son on, and provides the Peltier module 30 with the voltage adjusted in accordance with a duty control signal from the controller 7. The supply 5 also supplies the high voltage power supply 6 with voltage (V+).

The high voltage power supply 6 comprises, for example, a current detector 61, a voltage detector 62 and a high voltage generator 63, and further comprises a voltage stabilizing block 60. The detector 61 detects a current (discharge current) flowing between the electrodes 1 and 2, and provides the controller 7 (AD input) with a detected current signal (voltage Vi). The detector 62 detects voltage (discharge voltage) applied across the electrodes 1 and 2, and provides the controller 7 (AD input) with a detected voltage signal (voltage Vv). The generator 63 generates high voltage for discharge to apply across the electrodes 1 and 2 in accordance with the ON control signal from the controller 7, and also stops generating the high voltage in accordance with the OFF control signal from the controller 7. Details of each part of the power supply 6 is described later.

The controller 7 is formed of, for example, a micon (microcomputer), a storage device, A/D converters and so on, and controls output of the DC power supply 5 and output of the high voltage power supply 6 based on the voltage and the current from the detectors 61 and 62. The power supplies are controlled by various modes such as, for example, a start mode, a discharge current control mode and so on.

For example, in case of the start mode (when it is started), the discharge electrode 1 is not yet cooled and dew is not formed on the electrode 1. Because of this, the controller 7 provides the DC power supply 5 with an initial duty control signal for a given time so that the output voltage of the power supply 5 (converter 50) becomes predetermined initial voltage. Thereby, a cooling rate of the Peltier module 30 is adjusted to an initial cooling rate and then dew is formed on the electrode 1. It is allowable to calculate time during which dew is admitted to be formed on the electrode 1 based on each detection value of the sensing block 4 and voltage applied across the module 30, and said given time may be set to the calculated time. Also, the controller 7 may control: to apply high voltage across the electrodes 1 and 2 through the high voltage power supply 6 while stepwise raising voltage of the module 30; and to confirm whether or not dew is formed on the electrode 1 based on the current detected with the current detector 61.

In case of the discharge current control mode, the controller 7 supplies the ON control signal to the high voltage power supply 6 so that the power supply 6 generates high voltage to apply across the electrodes 1 and 2. At the same time, the controller 7 supplies a duty control signal to the DC power supply 5 so that the cooling rate of the Peltier module 30 is adjusted by adjusting the output voltage of the power supply 5 based on at least the current, of the current detected with the current detector 61 and the voltage detected with the voltage detector 62. Thereby, when a discharge is generated between the electrodes 1 and 2 in condition that dew as water is formed on the discharge electrode 1, the water on the electrode 1 is pulled toward the counter electrode 2 side to shape a Taylor cone. Rayleigh splitting then occurs at the tip of the Taylor cone, so that mist of charged fine particles in the order of nanometer in size is generated.

In order to generate the mist stably, it is necessary to adjust quantity of the dew on the discharge electrode 1 to appropriate quantity determined at design stage (specified quantity within specified range). If the quantity of dew on the electrode 1 is much less than the specified quantity, the discharge occurs not between the water and the counter electrode 2 but between the electrodes 1 and 2, which brings about the occurrence of ozone or the like. On the contrary, if the quantity of dew on the electrode 1 is much greater than the specified quantity, a short circuit current flows between the water and the electrode 2 that are shorter, which makes it impossible to generate mist of charged fine particles of object size. On account of this, in the discharge current control mode, relation between current (discharge current) detected with the current detector 61 and length of the Taylor cone is utilized. That is, if the quantity of dew on the electrode 1 is little, the length of the Taylor cone becomes short and a value of current detected with the detector 61 becomes small. On the other hand, if the quantity of dew on the electrode 1 is much, the length of the Taylor cone becomes long and a value of current detected with the detector 61 becomes large. Thus, by detecting a current flowing between the electrodes 1 and 2 through the detector 61, the length of the Taylor cone (quantity of dew) can be known. Accordingly, if a value of current detected with the detector 61 is smaller than the value of a predetermined reference current, the controller 7 supplies a duty control signal to the DC power supply 5 so as to raise output voltage of the power supply 5 to raise the cooling rate of the Peltier module 30. Conversely, if a value of current detected with the detector 61 is larger than the value of the reference current, the controller 7 supplies a duty control signal to the power supply 5 so as to lower output voltage of the power supply 5 to lower the cooling rate.

Figure 2:
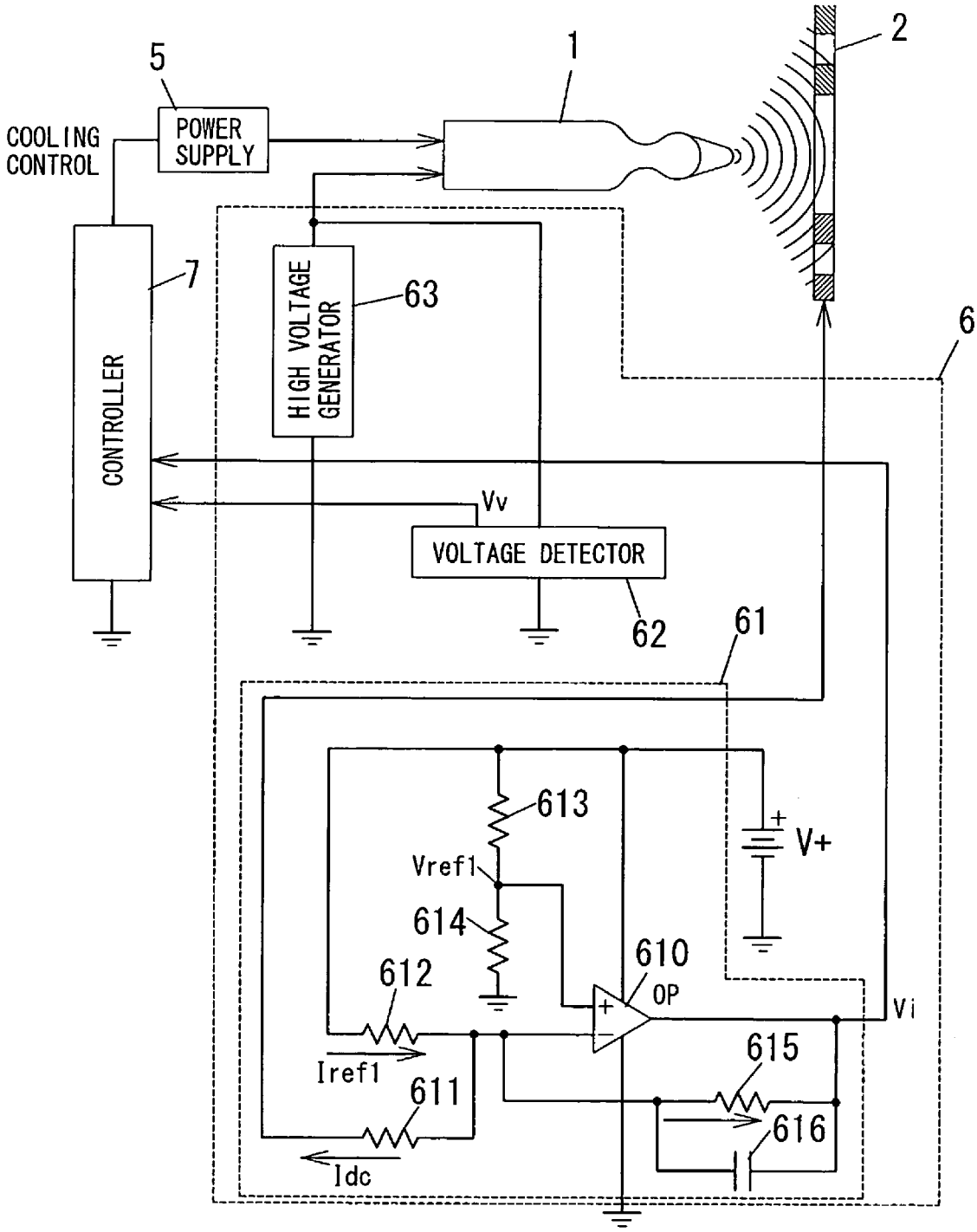
FIG. 2 is a circuit diagram of mainly a current detector of FIG. 1.
Figure 3:
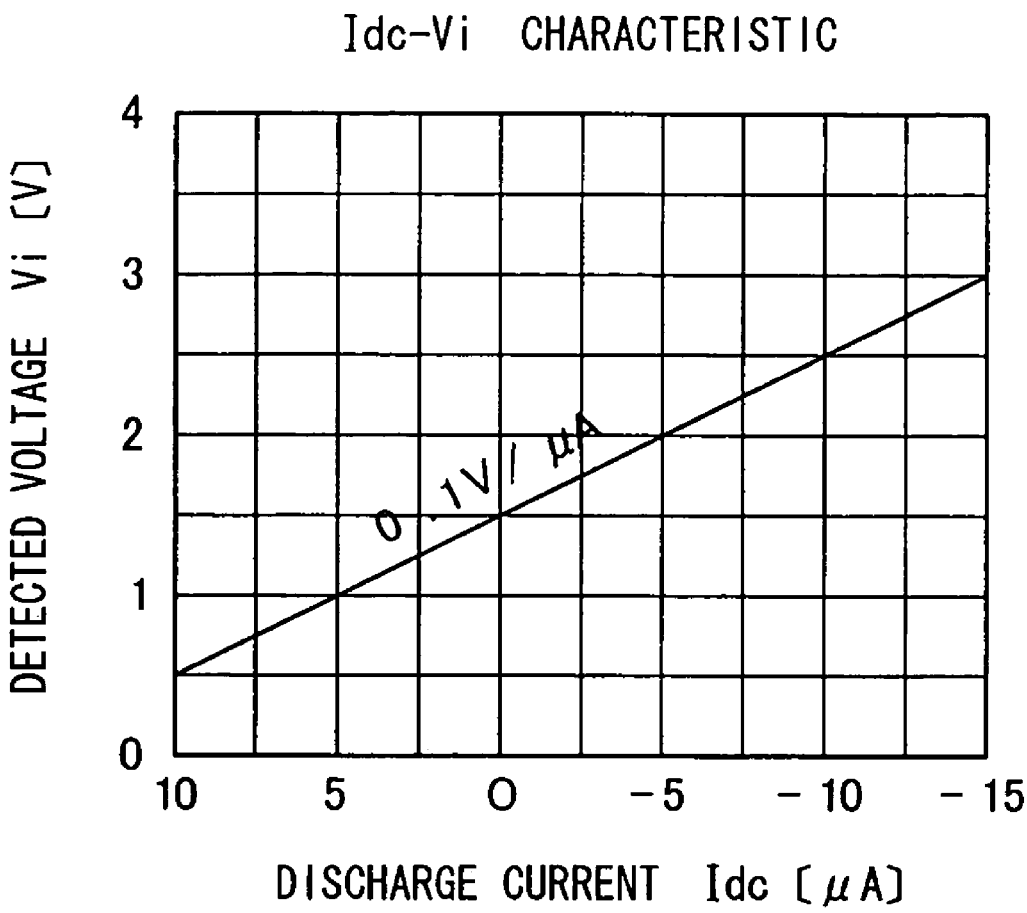
FIG. 3 illustrates an input-output characteristic of the current detector of FIG. 2.

Each part of the high voltage power supply 6 is herein explained in detail. As shown in FIG. 2, the current detector 61 is, for example, a summing amplifier circuit formed of an operational amplifier 610, resistors 611-615 and a capacitor 616, and has an input-output (Idc-Vi) characteristic of 0.1V/μA as shown in FIG. 3. That is, the detector 61 picks up the current Idc flowing between the electrodes 1 and 2 via the resistor 611 inserted into the discharge circuit, and adds the current Idc to a reference current Iref1 and then provides the controller 7 with voltage Vi corresponding to the sum of Idc and Iref1 (Vi=Vref1−R615×(Iref1+Idc)), where Vref1 is reference voltage and R615 is resistance of the resistor 615. In FIG. 2, since the direction of the current Idc corresponds to negative, the voltage Vi is given by Vref1−R615×(Iref1−Idc). But the summing amplifier circuit can provide the controller 7 with the Vi corresponding to the sum of Idc and Iref1 regardless of the direction of the current Idc (positive or negative) as shown in FIG. 3. The slope of Idc-Vi in FIG. 3 is set with the resistor 615. Since the resistance of the discharge circuit is much high, the resistor 611 is set to a value within the range that does not influence a discharge current and is 100 kΩ in FIG. 3. The detector 61 is also configured to include offset voltage (Vi in case of Idc=0) for reducing error of the detection result (Vi) caused by dispersion in circuit parts. That is, the error appears in the output of the detector 61 owing to dispersion in the reference voltage, the offset current and the offset voltage of the operational amplifier 610 and the like. The offset voltage of the detector 61 is set so as to measure and reduce the error and is 1.5 [V] in FIG. 3. Temperature drift depending on temperature change can be cancelled even in operation (e.g., discharge current control mode) by measuring the offset voltage of the detector 61 during discharge stop.

Figure 4:
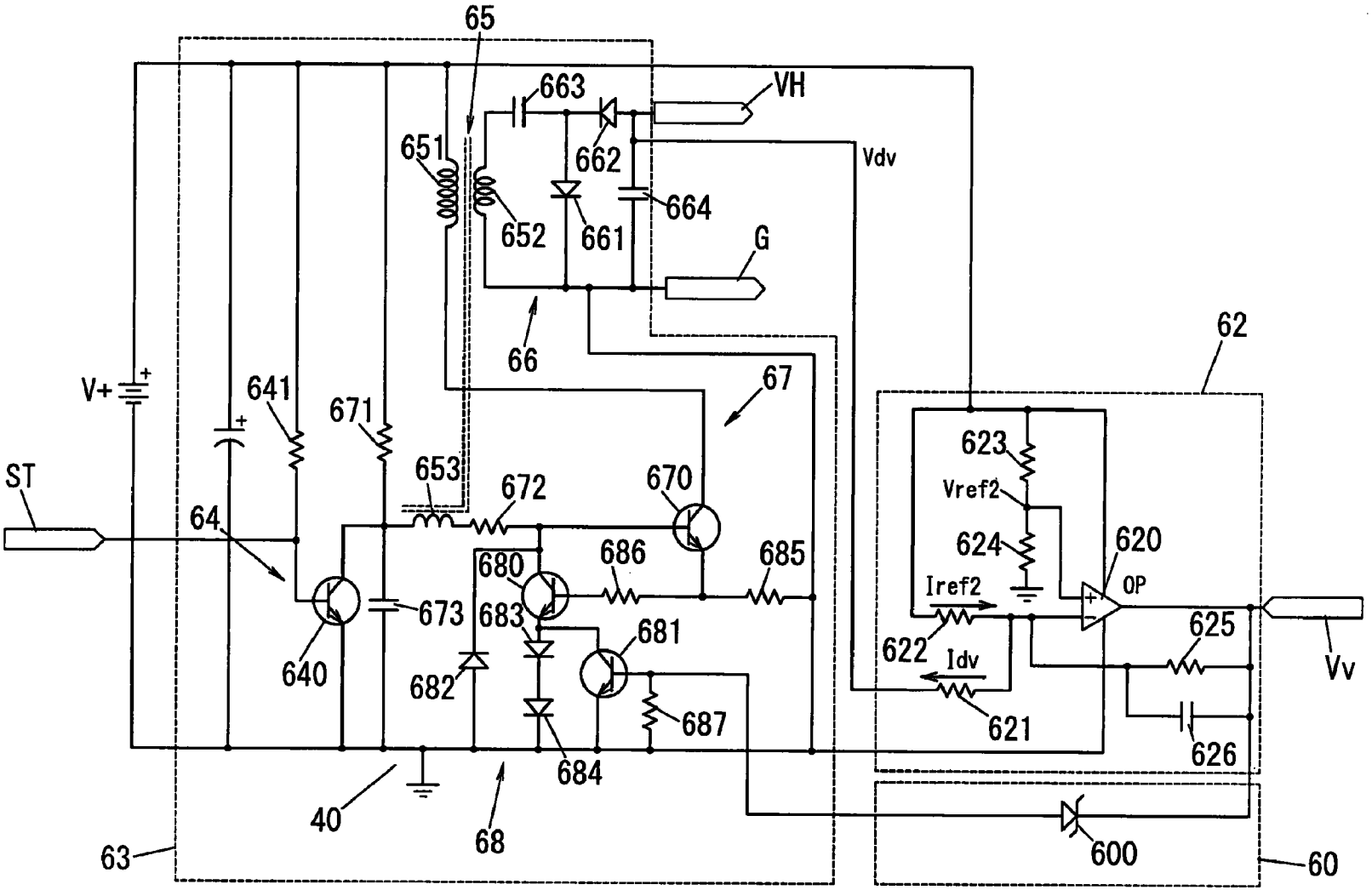
FIG. 4 is a circuit diagram of a high voltage power supply of FIG. 1.
Figure 5:
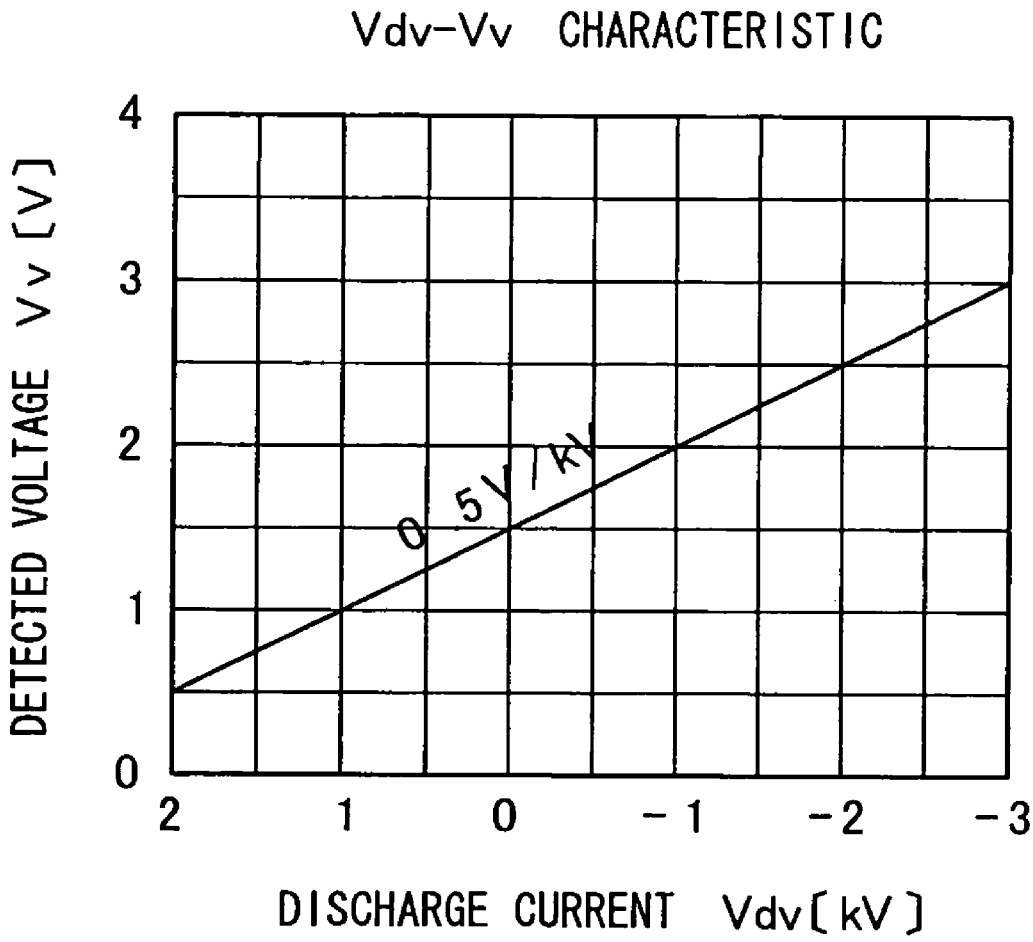
FIG. 5 illustrates an input-output characteristic of a voltage detector of FIG. 4.

As shown in FIG. 4, the voltage detector 62 is also, for example, a summing amplifier circuit formed of an operational amplifier 620, resistors 621-625 and a capacitor 626, and has an input-output (Vdv-Vv) characteristic of 0.5V/kV as shown in FIG. 5. That is, the detector 62 picks up a current Idv (Idv=Vdv/R621) as the voltage Vdv applied across the electrodes 1 and 2 via the resistor 621 connected with the output of the high voltage generator 63, and adds the current Idv to a reference current Iref2 and then provides the controller 7 with voltage Vv corresponding to the sum of Idv and Iref2 (Vv=Vref2−R625×(Iref2+Vdv/R621)), where Vref2 is reference voltage and R621 and R625 are resistance of the resistors 621 and 625, respectively. In FIG. 4, since the direction of the current Idv corresponds to negative, the voltage Vv is given by Vref2−R625×(Iref2−Vdv/R621). The slope of Vdv-Vv is set with the resistors 621 and 625 which are 500 MΩ and 250 kΩ, respectively in FIG. 5. The detector 62 also includes offset voltage (Vv in case of Vdv=0) in the same way as the detector 61 and is 1.5 [V] in FIG. 5. Temperature drift depending on temperature change can be cancelled even in operation by measuring the offset voltage of the detector 62 during discharge stop.

As shown in FIG. 4, the high voltage generator 63 can be divided into an ON/OFF circuit 64, a step-up transformer 65, a voltage doubler circuit 66, a oscillation circuit 67 and a control circuit 68. The circuit 64 is formed of, for example, a transistor 640 as a switch and a resistor 641, and turns the generator 63 on/off according to the ON/OFF signals from the controller 7, respectively. That is, the transistor 640 turns on the circuit 67 according to the ON control signal (LOW signal) to turn on the generator 63. The transistor 640 also turns off the circuit 67 according to the OFF control signal (HIGH signal or OPEN signal) to turn off the generator 63. In short, the generator 63 is usually off and generates high voltage only when it is worked. The transformer 65 has a primary winding 651 and secondary windings 652 and 653, and respectively induces high voltage and ON voltage across the windings 652 and 653 in response to voltage applied across the winding 651. The windings 651 and 653 are also utilized as construction elements of the circuit 67.

The voltage doubler circuit 66 is formed of, for example, diodes 661 and 662 and capacitors 663 and 664. This circuit 66 adds the high voltage induced across the secondary winding 652 and voltage across the capacitor 663 charged with the high voltage to charge the capacitor 664 with two times of the high voltage, and then applies voltage of the capacitor 664 (negative voltage) across the electrodes 1 and 2. Therefore, constant high voltage is applied across the electrodes 1 and 2 from the capacitor 664. The terminal G of FIG. 4 is connected to ground of the oscillation circuit 67 or to ground via the resistor for detecting a discharge current.

The oscillation circuit 67 is formed of, for example, a transistor 670 as a switching element, resistors 671 and 672 and a capacitor 673 in addition to said windings 651 and 653. This circuit 67 itself is an astable oscillator that oscillates in free running mode, but the circuit 67 under control of the control circuit 68 generates oscillation voltage while adjusting off timing of the transistor 670 according to the control and then applies the voltage across the winding 651. The capacitor 673 is provided to make switching of the transistor 670 faster and to reduce the switching loss.

That is, when the transistor 640 is turned off according to the ON control signal from condition that the transistor 640 is held on according to the OFF control signal to hold the transistor 670 off, voltage V+ is applied to the base of the transistor 670 through the resistor 671, the winding 653 and the resistor 672. A base current then flows between the base-emitter of the transistor 670. Thereby, the collector voltage of the transistor 670 is reduced by voltage across its collector-emitter and corresponding voltage is applied across the winding 651. Then, induction voltage is induced across the winding 653 magnetically coupled to the winding 651 through positive feedback of the voltage increase from the winding 651 to the winding 653 and then is applied to the base of the transistor 670. Consequently, the transistor 670 is rapidly turned on through the positive feedback of the voltage increase, and then voltage (oscillation voltage) is applied across the winding 651 to be stepped up with the transformer 65 and the circuit 66. In a general astable oscillator, for example, the base current of a transistor corresponding to the transistor 670 is decreased after its collector current reaches the level obtained by multiplying the base current by $h_{FE}$ of the transistor, and then voltage across an inductor corresponding to the winding 651 is reduced, so that the transistor is rapidly turned off. But in the embodiment, off timing of the transistor 670 is controlled through the control circuit 68.

The control circuit 68 is formed with, for example, a transistor 680 as a switch element; a transistor 681 as an amplification element (control device) for adjusting off timing of the transistor 670; diodes 682-684; and resistors 685-687. The diode 682 is provided in order to prevent voltage across the winding 653 from being applied as reverse bias across each base-emitter of the transistors 640, 670, 680 and 681 when the transistor 670 is turned off.

The transistor 680, the diodes 683 and 684 and the resistors 685 and 686 are provided to mainly turn the transistor 670 off. That is, when the transistor 670 is rapidly turned on through the positive feedback of the voltage increase, the collector current of the transistor 670 increases in proportion to time. Accordingly, voltage across the resistor 685 increases in proportion to time under control of said control device (681) and then the transistor 680 is turned on with voltage across the resistor 685. As a result, since the diodes 683 and 684 are connected in series between the base of the transistor 670 and ground via the transistor 680, the base current of the transistor 670 is decreased. Thus, once the base current is decreased, the collector current of the transistor 670 is decreased and then the voltage across the winding 561 is lowered. Therefore, the transistor 670 is rapidly turned of through positive feed back of voltage decrease from the winding 651 to the winding 653. The fundamental and latest on timing of the transistor 680 is determined by relation between V685 and sum voltage of V680$_{BE}$ and V680$_{BG}$, where V685 is voltage across the resistor 685, and V680$_{BE}$ and V680$_{BG}$ are base-emitter voltage of the transistor 680 and the emitter-ground voltage (voltage across the diodes 683 and 684), respectively. Therefore, the resistor 685 is set in consideration of not only the on timing but also the fundamental and latest off timing of the transistor 670. In other words, the peak current of the resistor 685 is decreased and restricted.

The transistor 681 and the resistor 687 adjust on timing of the transistor 680 within range restricted with the diodes 683 and 684 in response to voltage (Vv) detected with the voltage detector 62, and then adjust off timing of the transistor 670. That is, since the transistor 681 is connected in parallel with the diodes 683 and 684, said sum voltage is adjusted in accordance with the input-output (Vv corresponding to discharge voltage-collector voltage) characteristic of the transistor 681 shown in "A" of FIG. 6. Specifically, if a current Idv corresponding to discharge voltage Vdv across the electrodes 1 and 2 becomes larger than the reference current Iref2, the voltage Vv and base voltage of the transistor 681 become higher and the collect voltage of the transistor 681 becomes lower in accordance with the characteristic A of FIG. 6. Therefore, the sum voltage becomes lower. Thereby, since on timing of the transistor 680 becomes earlier and off timing of the transistor 670 becomes earlier, the voltage Vdv can be lowered. Conversely, if the current Idv becomes smaller than the reference current Iref2, the voltage Vv and base voltage of the transistor 681 become lower and the collect voltage of the transistor 681 becomes higher, and therefore the sum voltage becomes higher. Thereby, since on timing of the transistor 680 becomes later and off timing of the transistor 670 becomes later, voltage Vdv can be raised. Thus, by repeatedly turning the transistor 670 on and off to apply oscillation voltage across the winding 651, it is possible to stably generate high voltage through the high voltage generator 63.

As mentioned above, the high voltage generator 63 can stably generate high voltage in response to voltage detected with the voltage detector 62. In the embodiment, the voltage stabilizing block 60 is provided in order to generate high voltage more stably. That is, the high voltage generator 63 includes the transistor 681 and the voltage stabilizing block 60 that are opposite to each other in temperature characteristic, and this block 60 is formed of, for example, a zener diode 600. Accordingly, the transistor 681 operates to receive the voltage detected with the detector 62 via the voltage stabilizing block 60 and to adjust the high voltage applied across the electrodes 1 and 2 through feedback control so that the received voltage corresponds to specified discharge voltage (voltage corresponding to Iref2).

Figure 6:
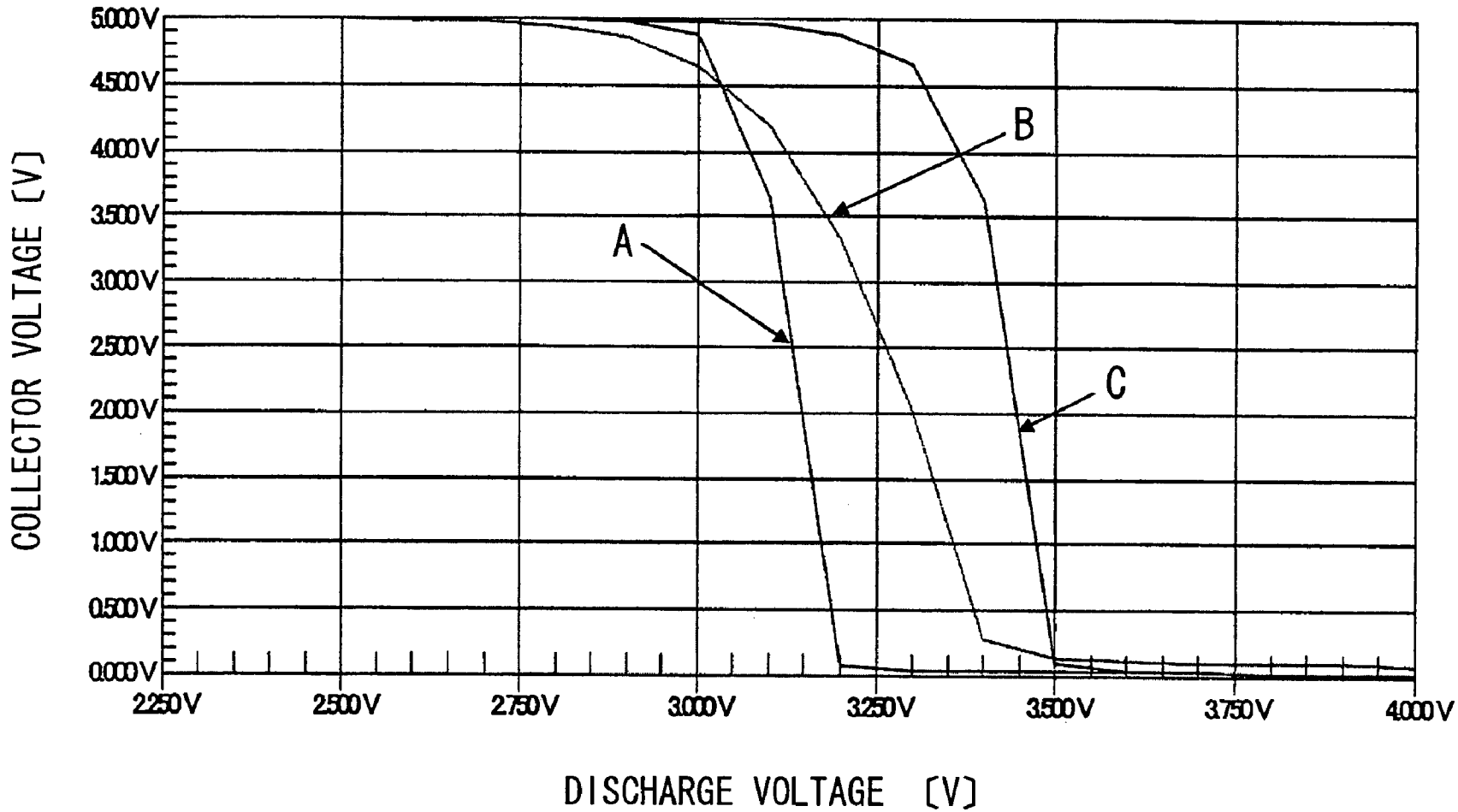
FIG. 6 illustrates an input-output characteristic of a control device of FIG. 4.

If a resistor of resistance R is utilized instead of the voltage stabilizing block 60, the input-output characteristic of the transistor 681 becomes a characteristic such as "B" of FIG. 6. In this characteristic, the relation of $Vv=(1+R/R687)\times V681_{BE}$ is satisfied when the transistor 681 is operated, where R687 is resistance of the resistor 687 and $V681_{BE}$ is the base-emitter voltage of the transistor 681 (about 0.7 V). In this case, when the base-emitter voltage of the transistor 681 is lowered in response to rise of ambient temperature, the discharge voltage between the electrodes 1 and 2 is lowered.

In the embodiment, it is considered that the transistor 681 has negative temperature characteristic of about −3 mV/° C. at PN junction between the base-emitter. Accordingly, the voltage stabilizing block 60 is provided, and is preferably located in proximity to the transistor 681. The block 60 has temperature characteristic that is opposite to the temperature characteristic of the transistor 681. Also, from the relation like said formula, the block 60 and the resistor 687 are set so that output voltage of the voltage detector 62 corresponds to desired discharge voltage. In case that the block 60 is formed of the zener diode 600, the zener diode is used, of which temperature coefficient is zero around 5V and becomes positive in equal to or more than 5V. Thereby, it is possible to cancel the negative temperature coefficient of the transistor 681 and tune the temperature coefficient of the high voltage generator 63 to zero. Thus, by providing the block 60, discharge voltage variation caused by ambient temperature change can be prevented and high voltage can be generated more stably. The level of the discharge voltage can be also controlled with higher accuracy than that in case of resistor, through the steep characteristic of "A" in FIG. 6.

Figure 7:
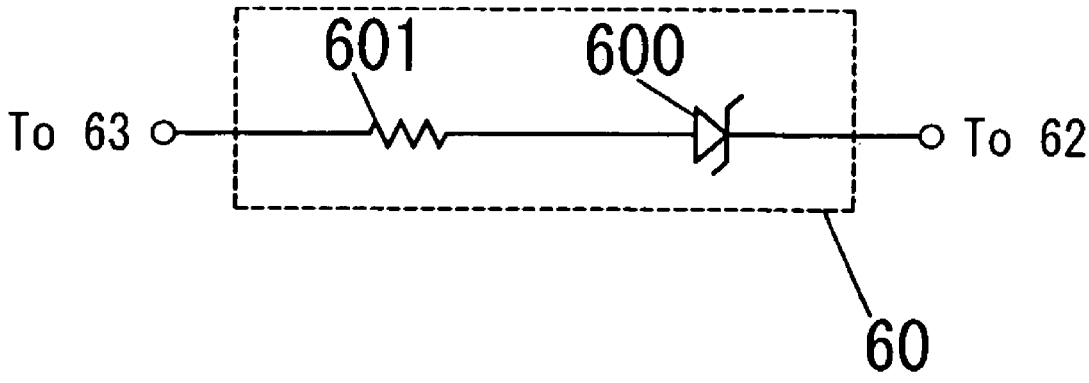
FIG. 7 is a circuit diagram of a voltage stabilizing block in an alternate embodiment.
Figure 8:
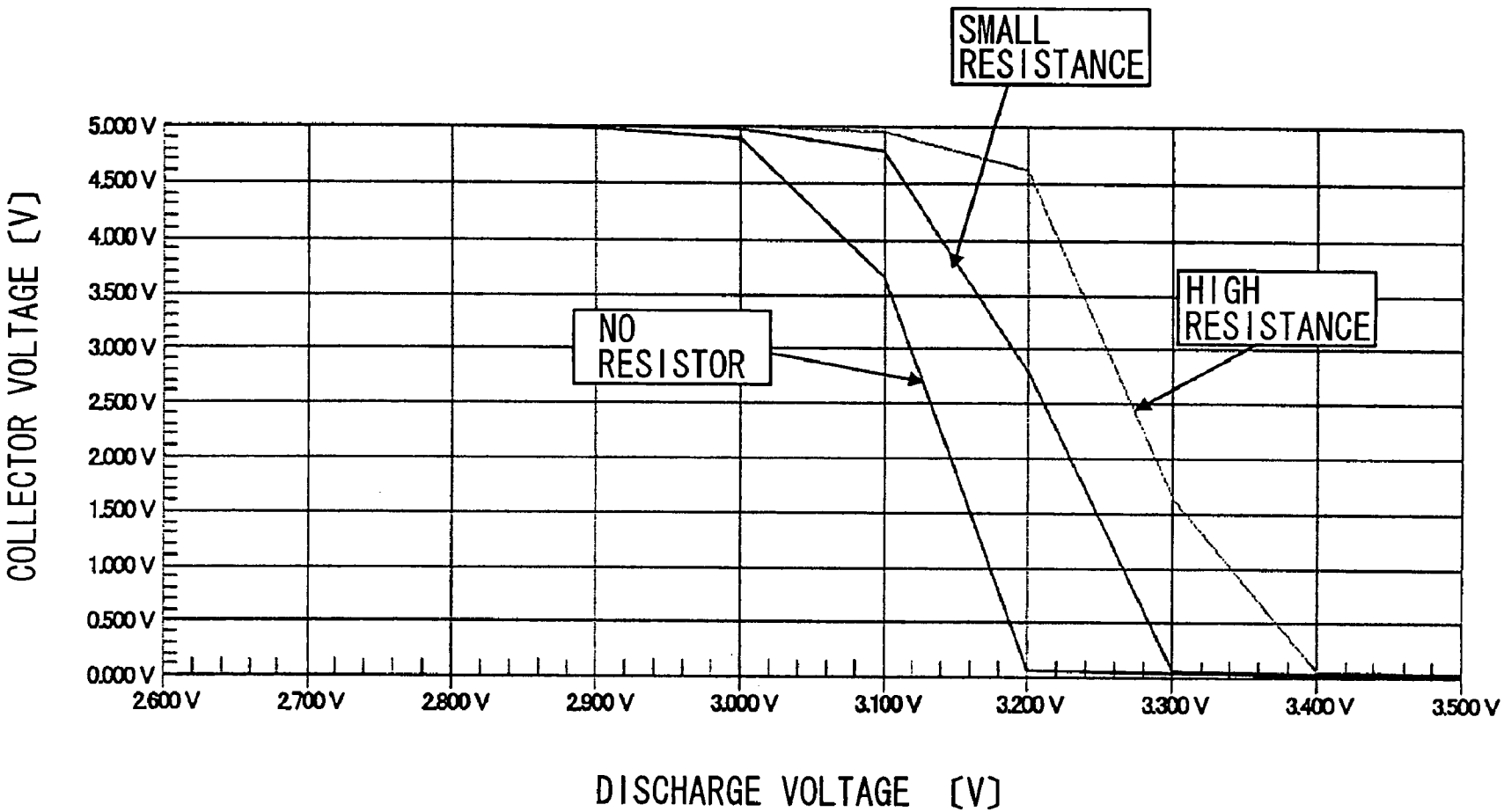
FIG. 8 illustrates an input-output characteristic of a control device in the embodiment of FIG. 7.

In an alternate embodiment, as shown in FIG. 7, the voltage stabilizing block 60 of the high voltage power supply 6 is formed of the zener diode 600 and a resistor (fixed resistor or variable resistor) 601. In case that the resistor 601 is a variable resistor, the input-output characteristic of the transistor 681 can be changed as shown in FIG. 8.

Figure 9:
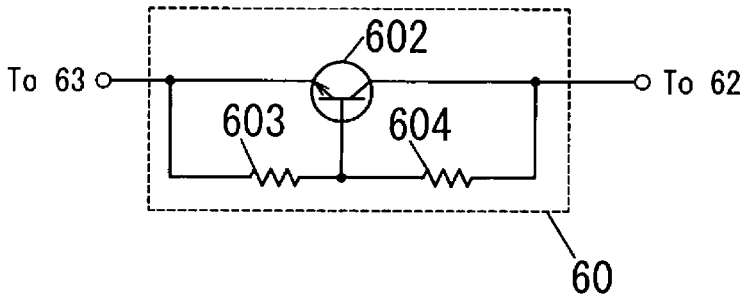
FIG. 9 is a circuit diagram of a voltage stabilizing block in another alternate embodiment.

In another alternate embodiment, as shown in FIG. 9, the voltage stabilizing block 60 is formed of a transistor 602 and resistors 603 and 604. In this case, the transistor 681 has an input-output characteristic such as "C" of FIG. 6.

In an enhanced embodiment, the controller 7 supplies a duty control signal to the DC power supply 5 so as to adjust cooling rate of the Peltier module 30 by adjusting output voltage of the power supply 5 based on the current detected with the current detector 61 and the voltage detected with the voltage detector 62. Herein, discharge voltage (V(m)) is previously selected by a user from voltage ranges shown in Table 1. Because of this, if voltage across the electrodes 1 and 2 changes, a value of discharge current showing quantity of dew formed on the discharge electrode 1 changes as well. Accordingly, the voltage (discharge voltage) detected with the detector 62 is further utilized. In addition, as shown in Table 1, predetermined mid-value Imid(n) (value of reference current), maximum value Imax(n) (threshold Imax) and minimum value Imin(n) are selected every discharge voltage V(m). Therefore, the controller 7 supplies a duty control signal to the power supply 5 so that a current detected with the detector 61 becomes the mid-value corresponding to voltage detected with the detector 62.

TABLE 1

| Discharge | Discharge Curent I(m) [μA] | | |
|---|---|---|---|
| Voltage V(m) [-kV] | Minimum Value Imin(n) | Mid-Value Imid(n) | Maximum Value Imax(n) |
| $4.1 \leqq V(m) < 4.2$ | $Imin(1) = I_1 - A_1$ | $Imid(1) = I_1$ | $Imax(1) = I_1 + A_1$ |
| $4.2 \leqq V(m) < 4.3$ | $Imin(2) = I_2 - A_2$ | $Imid(2) = I_2$ | $Imax(2) = I_2 + A_2$ |
| $4.3 \leqq V(m) < 4.4$ | $Imin(3) = I_3 - A_3$ | $Imid(3) = I_3$ | $Imax(3) = I_3 + A_3$ |
| $4.4 \leqq V(m) < 4.5$ | $Imin(4) = I_4 - A_4$ | $Imid(4) = I_4$ | $Imax(4) = I_4 + A_4$ |
| $4.5 \leqq V(m) < 4.6$ | $Imin(5) = I_5 - A_5$ | $Imid(5) = I_5$ | $Imax(5) = I_5 + A_5$ |
| $4.6 \leqq V(m) < 4.7$ | $Imin(6) = I_6 - A_6$ | $Imid(6) = I_6$ | $Imax(6) = I_6 + A_6$ |
| $4.7 \leqq V(m) < 4.8$ | $Imin(7) = I_7 - A_7$ | $Imid(7) = I_7$ | $Imax(7) = I_7 + A_7$ |
| $4.8 \leqq V(m) < 4.9$ | $Imin(8) = I_8 - A_8$ | $Imid(8) = I_8$ | $Imax(8) = I_8 + A_8$ |
| $4.9 \leqq V(m) < 5.0$ | $Imin(9) = I_9 - A_9$ | $Imid(9) = I_9$ | $Imax(9) = I_9 + A_9$ |

TABLE 1-continued

| Discharge | Discharge Curent I(m) [μA] | | |
|---|---|---|---|
| Voltage V(m) [-kV] | Minimum Value Imin(n) | Mid-Value Imid(n) | Maximum Value Imax(n) |
| $5.0 \leqq V(m) < 5.1$ | $Imin(10) = I_{10} - A_{10}$ | $Imid(10) = I_{10}$ | $Imax(10) = I_{10} + A_{10}$ |
| $5.1 \leqq V(m) < 5.2$ | $Imin(11) = I_{11} - A_{11}$ | $Imid(11) = I_{11}$ | $Imax(11) = I_{11} + A_{11}$ |

Figure 10:
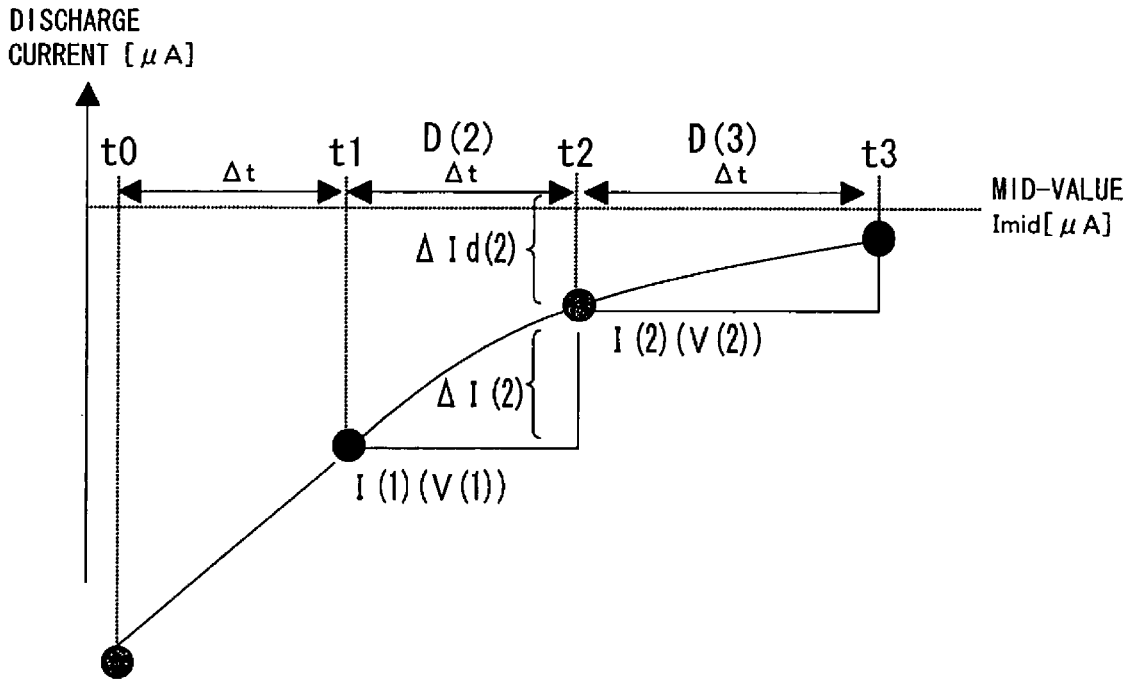
FIG. 10 is an explanatory diagram of discharge current control in an enhanced embodiment.

As shown in FIG. 10, the controller 7 also supplies a duty control signal to the DC power supply 5 so that a cooling rate of the Peltier module 30 approximates to the cooling rate corresponding to the mid-value without overshoot, based on the current detected with the current detector 61 and the voltage detected with the voltage detector 62. Specifically, after stability of each block of the electrostatic atomizer, the controller 7 averages the current and voltage detected with the detectors 61 and 62 every specified period Δt. For example, when each block is stable (t0), the controller 7 starts picking up the current and voltage from the detectors 61 and 62. At a point in time t1 after the period Δt, the controller 7 calculates a mean value of the current values and a mean value of the voltage values as discharge current I(1) and discharge voltage V(1), respectively. Similarly, at a point in time t2, the controller 7 calculates discharge current I(2) and discharge voltage V(2). At this point, the controller 7 calculates the difference in discharge currents between t1 and t2 (ΔI(2)=I(2)−I(1)) and reads mid-value (Imid(n), t=t1) corresponding to V(1) from Table 1. And the controller 7 calculates the difference ($\Delta Id(2)=Imid(n)_{\{t=t1\}}-I(2)$) from I(2). The controller 7 then calculates increment (ΔD(2)=Pa×ΔId(2)−Pb×ΔI(2)) for duty (D(3)) with respect to the power supply 5 between t2 and t3, and figures out duty between t2 and t3 (D(3)=D(2)+ΔD(2)) from duty between t1 and t2 (D(2)), where Pa and Pb are parameters and D(2), D(3) or the like corresponds to any of D1-D256 obtained by dividing duty of 0-100% into 256. After t3 as well, the controller 7 calculates duty increment (ΔD(m)=Pa×ΔId(m)−Pb×ΔI(m)) and then supplies a duty control signal to the power supply 5.

However, in case that the duty increment ΔD(m) is calculated, the increment ΔD(m) may be calculated by using a correction function F{D(m−1)} in response to a value of the previous increment ΔD(m−1), i.e., by (Pa×ΔId(m)−Pb×ΔI(m))×F{D(m−1)}. The function F{D(m) has a small value in case that the previous duty D(m−1) is low, and has a large value in case that D(m−1) is high. Thereby, it is possible to weight the whole duty. When duty is low, voltage to the Peltier module 30 is also low and cooling temperature ΔT of the discharge electrode 1 is low domain as well, and therefore dew is easily formed thereon. Accordingly, it is possible to prevent excess dew from being formed by setting the value of the correction function to, for example, 0.5. Conversely, when duty is high, cooling temperature ΔT is also high and dew is hardly formed, and therefore the value of the correction function is set to, for example, 2 in order to enlarge rate of change. For example, in case of high humidity in which room temperature is 25° C. and dew point is 20° C., ΔT is 5° C. Also, in case of low humidity in which room temperature is 25° C. and dew point is 10° C., ΔT is 15° C.

Although the present invention has been described with reference to certain preferred embodiments, numerous modifications and variations can be made by those skilled in the art without departing from the true spirit and scope of this invention.

The invention claimed is:

1. An electrostatic atomizer, comprising:

a discharge electrode;

a counter electrode located opposite the discharge electrode;

a cooling source that cools the discharge electrode to form thereon dew as water;

a high voltage power supply that applies high voltage for discharge across the electrodes; and a voltage detector that detects voltage between the electrodes;

wherein the power supply includes a control device and a voltage stabilizing device that are opposite to each other in temperature characteristic, the control device operating: to pick up the voltage detected with the detector via the voltage stabilizing device; and to adjust the high voltage applied across the electrodes through feedback control so that the voltage corresponds to a specified discharge voltage.

2. The electrostatic atomizer of claim 1, further comprising:

a current detector that detects a current flowing between the electrodes; and a controller that adjusts a cooling rate of the cooling source based on a value of a predetermined specified current;

wherein the controller raises the cooling rate when a value of the current detected with the current detector is smaller than the value of the specified current, and lowers the rate when the value of the current is larger than the value of the specified current.

3. The electrostatic atomizer of claim 2, wherein:

the control device is a transistor; and the voltage stabilizing device has the opposite temperature characteristic in comparison with the temperature characteristic between the base and emitter of the control device.

4. The electrostatic atomizer of claim 2, further comprising a resistor for adjusting the high voltage of the power supply, the resistor being connected in series with the voltage stabilizing device.

5. The electrostatic atomizer of claim 3, further comprising a resistor for adjusting the high voltage of the power supply, the resistor being connected in series with the voltage stabilizing device.

* * * * *